United States Patent [19]

Schwary et al.

[11] 3,942,413

[45] Mar. 9, 1976

[54] LOAD LIMITING SYSTEM

[75] Inventors: Robert E. Schwary; Joseph A. Shurger, both of Wooster, Ohio

[73] Assignee: Borg-Warner Corporation, Chicago, Ill.

[22] Filed: Aug. 1, 1974

[21] Appl. No.: 493,589

[52] U.S. Cl. ..... 91/412; 60/426; 60/468; 91/451

[51] Int. Cl.[2] ..... F15B 11/16

[58] Field of Search ..... 91/412, 451, 468; 60/426, 60/446, 468

[56] References Cited

UNITED STATES PATENTS

| | | | |
|---|---|---|---|
| 2,374,630 | 4/1945 | Tucker | 60/426 |
| 3,391,537 | 7/1968 | Smith | 60/426 X |
| 3,535,877 | 10/1970 | Becker et al. | 91/412 X |
| 3,631,890 | 1/1972 | McMillen | 137/596.13 |
| 3,692,149 | 9/1972 | Evans | 91/445 X |
| 3,693,506 | 9/1972 | McMillen et al. | 91/433 X |
| 3,768,372 | 10/1973 | McMillen | 91/414 X |

FOREIGN PATENTS OR APPLICATIONS

| | | | |
|---|---|---|---|
| 2,030,382 | 12/1971 | Germany | 91/412 |
| 231,395 | 4/1969 | U.S.S.R. | 91/412 |

*Primary Examiner*—C. J. Husar
*Assistant Examiner*—Edward Look
*Attorney, Agent, or Firm*—Robert L. Zieg

[57] ABSTRACT

A load limiting hydraulic control system for a hydraulic cylinder adapted to raise or tilt a load including a control valve having an inlet port and a movable valving member adapted to direct pressure flow to said cylinder. A fluid responsive valve is connected to a source of fluid supply and said inlet port. A control circuit is provided connected to the control valve and the fluid responsive valve, and the fluid responsive valve is responsive to the pressure in the control circuit to control the fluid supplied to said control valve. The system incorporates a unique limit valve mechanism connected to the cylinder and the control circuit and is responsive to a predetermined pressure at the cylinder to interrupt the control circuit to reduce the fluid supply and prevent further actuation of the cylinder.

13 Claims, 4 Drawing Figures

12
86
114
14
96
16
96
94
84
156
94
92
82
92
90
10
80
98
104
100
22
104
24
20
26
52
52
60
60
62
68
68
50
50
66
62
66
64
70
112
54
65
54
63
65
102
53
99
32
114
37
120
33
30
118
37
34
28
36
102
102
116
18
110
19
110
19
37
55
156
165
170
53
163
115

LOAD LIMITING SYSTEM

Summary of Invention

In hydraulic control systems for controlling hydraulic work cylinders, for example those operating the lift forks of a lift truck, certain schemes have been developed such as limit switches to prevent the lifting and transporting of unsafe loads. The present invention comprises a mechanism to control the hydraulic cylinders for lift truck forks for both the lift and tilt functions providing a unique load limit system which prevents the operator from tilting the load forward or raising the load when the load moment acting on the truck is so large as to be unsafe. In a lift truck, for example, the load moment can be defined as the mathematical product of the force exerted by the load and the horizontal distance between the front axle centerline and the vertical projection of the load center of gravity.

The unique load limit system incorporates limit valves that respond to the pressure in one chamber of the tilt cylinder or cylinders. In a modified embodiment, the limit valves are connected to respond to the differential pressure between the two chambers of a tilt cylinder or cylinders. In cylinders used for tilting of a load, the chamber which is pressurized to tilt the load in a rearward direction under most conditions is also pressurized by the load attempting to tilt forward under its own weight, this pressure then reflects the amount of the load moment and can be used as a control signal. Due to the use of the unique logic system described in the present control system and described in particular in U.S. Pat. Nos. 3,526,247 and 3,693,506 of common assignee, a separate limit valve can be provided for the tilt manual control valve and the lift manual control valve each with its own pressure responsive setting. The unique system described herein also advantageously allows lowering or rearward tilting of a load under excess load moment conditions, at all times, since the valves of the load limiting system are connected with the logic control system described so as to be effective only during the lift and the tilt forward functions.

BRIEF DESCRIPTION OF THE DRAWINGS

Referring to FIG. 1, a load-responsive hydraulic control circuit 10 is illustrated for controlling a hydraulic motor or cylinder 12 for lifting a load and hydraulic cylinders or motors 14 and 16 for tilting a load. The particular hydraulic cylinders illustrated are used, for example, in lift trucks wherein the lift cylinder 12 would be used to raise and lower the lift forks 13 of the truck and the cylinders 14 and 16 referred to as tilt cylinders are used to tilt the mast 15 upon which the lift forks 13 ride up and down when a load is to be transported on the lift truck type of vehicle.

Figure 1A:
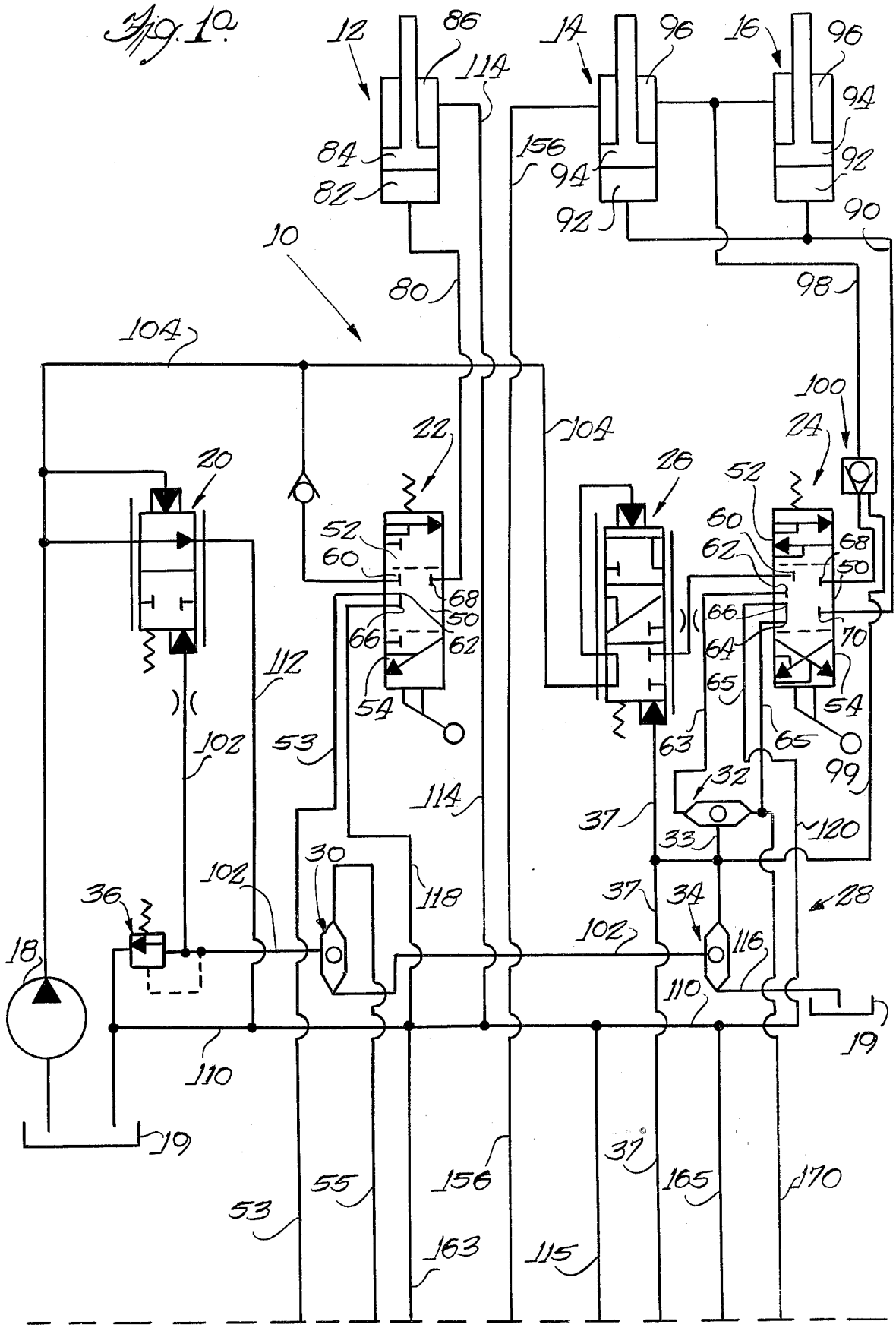
FIG. 1A is a part of a schematic view of a control system for hydraulic cylinders.

The circuit illustrated is similar to the load-responsive system disclosed and claimed in U.S. Pat. No. 3,693,506 of common assignee and the disclosure thereof is incorporated herein by reference. For a more precise and complete description of the operation of the manual control valves to control the cylinders 12, 14 and 16 than given herein, reference may be had to this patent.

Incorporated within the circuit 10 for controlling hydraulic cylinders 12, 14 and 16 is shown a fixed displacement pump 18 having a sump 19, an unloading or bypass valve 20, a manual control valve 22 for lift cylinder 12, a manual control valve 24 for tilt cylinders 14 and 16, and a flow control valve 26.

The circuit 10 further includes a control signal or logic system 28 to control operation of bypass valve 20 which incorporates three port shuttle valves or fluid responsive means 30, 32 and 34. A main relief valve 36 is provided to allow a predetermined maximum pressure within the control circuit for bypass valve 20. The invention described herein, comprises a unique load limiting system 40 incorporated in the circuit 10 which is adapted to prevent a lift truck or other device incorporating such a system from lifting or tilting unsafe loads which could be dangerous to the operator or the vehicle.

Figure 2:
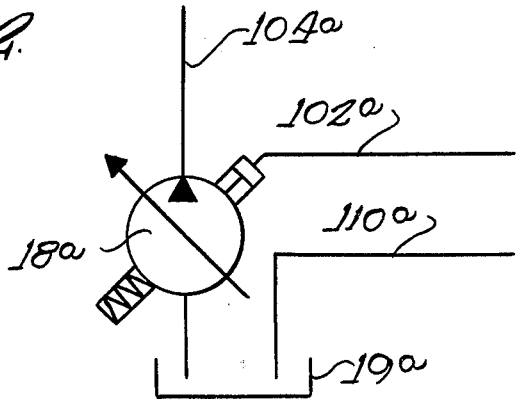
FIG. 2 is a schematic view showing the modification of the system of FIG. 1 to operate with a "closed-center" hydraulic system.

Manual control valves 22 and 24 are similar in operation each being patterned after the control valve 25 of FIG. 2 of U.S. Pat. No. 3,693,506. The valves 22 and 24 are three position valves each having a neutral position 50 and actuating positions 52 and 54. The manual control valves 22 and 24 each include an inlet port 60, a return port 66, and motor ports 68. Manual control valve 22 being used for single acting cylinder 12 has a single control port 62. Manual control valve 24 controlling double acting cylinders 14 and 16 has a pair of control ports 62 and 64, and an additional motor port 70.

The motor port 68 of valve 22 is connected by a conduit 80 with a fluid chamber 82 of lift cylinder 12 whereby the piston 84 of the cylinder 12 can be actuated to lift a load. The cylinder 12 also includes a fluid chamber 86 on the opposite side of piston 84.

Figure 1B:
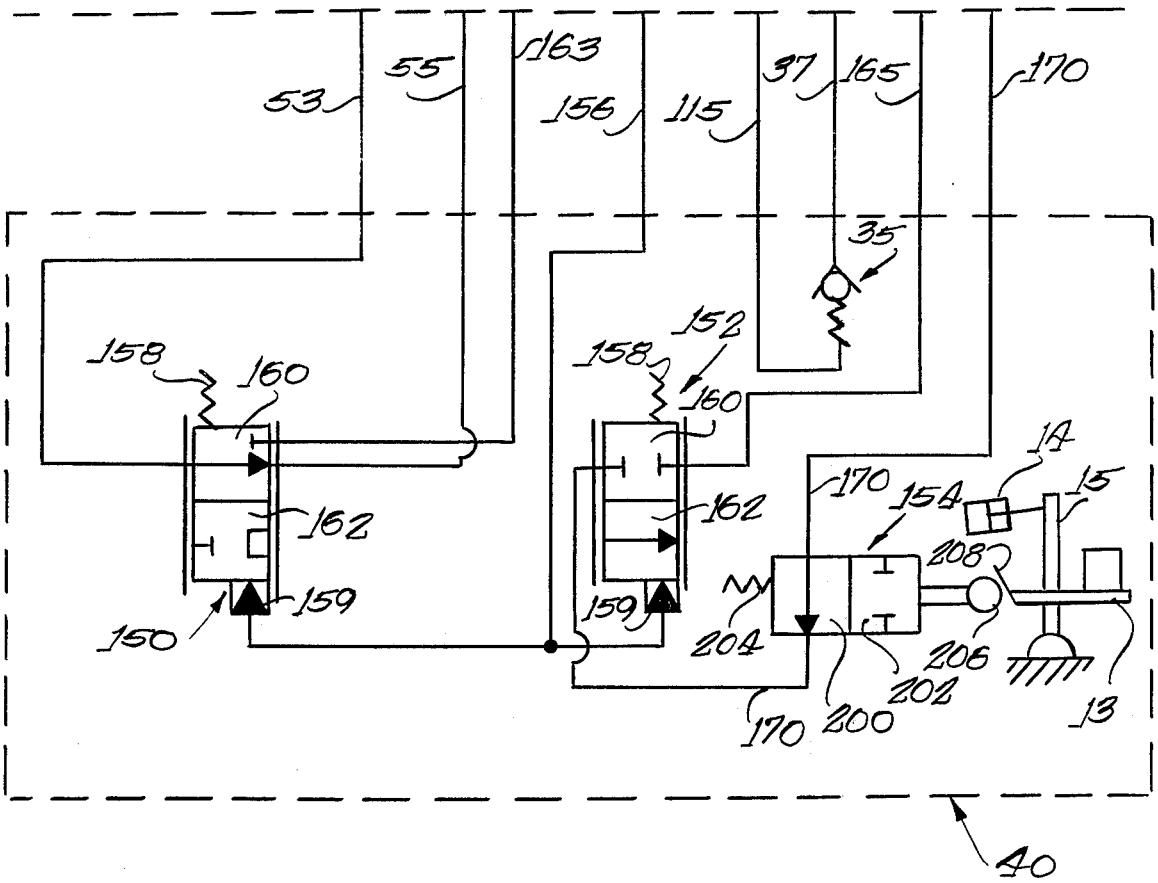
FIG. 1B is the second part of a schematic view showing the load limiting system which together with FIG. 1A discloses a complete control system for hydraulic cylinders incorporating the principles of the present invention.

Manual control valve 24 has its motor ports 68 and 70 connected to hydraulic cylinders 14 and 16. Motor port 70 is connected by conduit 90 with fluid chambers 92 of cylinders 14 and 16 whereby the pistons 94 of the cylinders may be actuated to move the mast 15 of the lift vehicle in a forward or clockwise direction as illustrated in FIG. 1. Motor port 68 of valve 24 is connected by a conduit 98 with fluid chambers 96 of cylinders 14 and 16 which are adapted when supplied with pressure to actuate pistons 94 to tilt the mast 15 counterclockwise or rearwardly as illustrated in FIG. 1. Provided in conduit 98 is a valve 100 having a tilt-lock function which acts to prevent depletion of pressure from chambers 96 of the tilt cylinders to prevent the mast 15 and the load carried thereby from tilting forward under undesirable conditions. The operation of the valve 100 is completely described in pending application U.S. Ser. No. 422,636 of common assignee and is valve 10 of FIG. 1 of that application. A conduit 99 connects valve 10 to the output of shuttle valve 32 to control valve 10 in the manner described in application Ser. No. 422,636 and corresponds to conduit 92 of that application.

The shuttle valve 32 of logic system 28 is connected to control port 62 by a conduit 63 and control port 64 by a conduit 65. When the system is in operation the shuttle valve 32 will connect the highest pressure in the motor ports 68 or 70 to the shuttle valve 34. Shuttle valves 34 and 30 are connected with a control signal conduit 102 which is adapted to actuate bypass valve 20 in the manner described in U.S. Pat. No. 3,693,506 with respect to bypass valve 18 therein illustrated to vary the pressure supplied to a supply conduit 104 to each of the inlet ports 60 of the manual valves 22 and 24. Provided in the supply conduit 104 in connection with inlet port 60 of valve 24 is a flow control valve 26 which is similar to the flow control valve disclosed and claimed in U.S. Pat. No. 3,592,216 of common assignee being valve 27 of that patent. The valve 26 serves to provide a pressure to manual control valve 24 controlled in accordance with the requirements of cylinders 14 and 16, a low standby pressure to valve 24 when it is in its neutral position, act as a load check valve when the pressure to one of the chambers of the cylinders exceeds the pressure supplied to the manual control valve, and provide a maximum pressure limit for the cylinders 14 and 16. The operation of the flow control valve 26 to obtain these functions is completely described in U.S. Pat. No. 3,592,216 mentioned above.

A relief valve 35 is provided connected to conduit 33 and flow control valve 26 by a conduit 37. Relief valve 35 determines the maximum load pressure which can be supplied to cylinders 14 and 16.

A return conduit 110 is provided connected to sump 19 to return fluid to the sump. Conduit 110 is connected to the bypass valve 20 by conduit 112, to chamber 86 of the lift cylinder 12 by conduit 114, relief valve 35 by conduit 115 and is adapted to return fluid to sump 19 from each of these locations. The conduit 110 is also connected to the return port 66 of valve 22 by a conduit 118 and to return port 66 of manual valve 24 by conduit 120. Conduit 116 may connect shuttle valve 34 to sump 19 as illustrated, or if other manual control valves are used in the system will connect shuttle valve 34 to additional similar shuttle valves.

Manual valve 22 when actuated to its position 52 connects inlet port 60 to motor port 68 to supply pressure to chamber 82 of cylinder 12 to lift a load. As is more completely described in U.S. Pat. No. 3,693,506 as well as U.S. Pat. No. 3,526,247 each of common assignee, at the same time the connection between the inlet port 60 and motor port 68 is made, a connection is made between motor port 68 and control port 62. Control port 62, assuming load limiting system 40 is not interrupting, will communicate the pressure in motor port 68 and in chamber 82 by a conduit 53 to valve 150 (to be described) and conduit 55 to shuttle valve 30. Shuttle valve 30 will compare this pressure with the highest motor port pressure of manual valve 24 from shuttle valve 34 and will automatically select the highest pressure to be supplied through conduit 102 to bypass valve 20, whereby bypass valve 20 will be set to meet the pressure requirements of the highest pressure indicated at either of the manual valves 22 or 24. This operation of the manual valves 22 and 24 to connect the motor port pressure to a control port whereby it is supplied to a control signal conduit 102 by means of logic system 28 to control pump 18 is particularly described in U.S. Pat. No. 3,526,247 and will not be repeated in detail in this description.

In position 54 of manual valve 22 the motor port 68 connected to chamber 82 is connected to the return port 66 whereby fluid will be exhausted from chamber 82 so that the pressure load is reduced and the load lowered. It should be understood that the amount of fluid supplied or exhausted can be adjusted since a variety of positions are available between the neutral and actuating positions of the manual valves creating an orifice between the inlet and motor ports or between the motor ports and return ports so that the work cylinders 12, 14 and 16 may be properly controlled.

With respect to manual control valve 24, it will be seen that in the power position 52 fluid from the inlet port 60 is connected to motor port 68 to act in chambers 96 and move pistons 94 to tilt the mast 15 of a lift truck counterclockwise as illustrated in FIG. 1. At the same time the pressure in chamber 96 is communicated to control port 62 whereby it flows through shuttle valve 32 and thus through shuttle valve 34 to be compared to the pressure in shuttle valve 30. At the same time in position 52 control port 64 and motor port 70 are connected to return port 66 to exhaust pressure from chambers 92 of cylinders 14 and 16 whereby movement of pistons 94 is permitted. In position 54 of manual valve 24 it will be seen that the inlet port 60 is connected to motor port 70 and that motor port 68 is connected to return conduit 120 to move the pistons 94 in the opposite direction to tilt the mast clockwise as illustrated in FIG. 1.

The above description describes briefly a control circuit for controlling work cylinders 12, 14 and 16 in a manner similar to the control system described in U.S. Pat. No. 3,693,506 mentioned above, however, the invention described herein relates to the above described control system with the addition of a unique load limiting system 40 which will now be described in detail.

Load limiting system 40 in general includes a lift limit valve 150, a tilt limit valve 152, and an over-ride valve 154. A conduit 156 connects each of the limit valves 150 and 152 with chambers 96 of hydraulic cylinders 14 and 16 whereby the valves 150 and 152 may be actuated by the pressure in those chambers. A spring 158 is provided for each of the limit valves 150 and 152 and acts on the valve in opposition to the pressure received through conduit 156. An actuator 159; which may comprise, for example, a fluid responsive area on a valve member; is provided for each of the valves 150 and 152. Actuators 159 are connected to conduit 156. Each of the valves 150 and 152 has an inactive position 160 and an active or load limiting position 162. As will be apparent when the pressure in chambers 96 of hydraulic cylinders 14 and 16 exceeds a predetermined value for the setting of either of the limit valves 150 or 152 actuator 159 will move the valve from position 160 to limiting position 162.

Limit valve 150 is in series between manual valve 22 and shuttle valve 30 and in the inactive position 160, valve 150 connects control port 62, which in turn is connected to the chamber 82 of lift cylinder 12, to the shuttle valve 30 through conduit 55 so that the manual valve 22 can operate to actuate or lift a load. In the limiting position 162, valve 150 connects control port 62 and thereby motor port 68 and chamber 82 of cylinder 12 to return conduit 110 by means of a conduit 163. It will be apparent then that when valve 150 is in position 162, with control port 62 connected to return conduit 110, the valve 22 will be incapable of supplying additional pressure to chamber 82 of lift cylinder 12.

Tilt limit valve 152 is inactive in position 160, however, in position 162 to which it is moved by pressure in conduit 156, it will connect, by means of conduit 170, control port 64 of manual valve 24 to return conduit 110 by means of conduit 165, and thus manual valve 24 is unable to supply pressure to conduit 90 (as is normally the case in position 54 of manual valve 24) to actuate hydraulic cylinders 14 and 16 to move pistons 94 to tilt the mast 15 and the load forward, since a connection is open between control port 64 and return conduit 110. At this time, when the pressure in chambers 96 drops indicating a safe load condition, the spring 158 will return limit valve 152 to its inactive position interrupting the connection to the return line 110 and permitting normal operation of manual valve 24 to actuate hydraulic cylinders 14 and 16 in either direction.

Provided in the conduit 170 is a two position over-ride valve 154 which can act to over-ride the operation of the tilt limit valve 152 under certain conditions. Over-ride valve 154 has an inactive position 200 in which conduit 170 is not interrupted and the tilt limit valve 152 can operate to prevent actuation of hydraulic cylinders 14 and 16 in the forward tilting phase. In the active position 202, valve 154 will interrupt conduit 170 to over-ride the operation of tilt limit valve 152 and permit normal operation of manual valve 24 even though the load, as measured in chambers 96, is exceeding a safe limit. A spring 204 urges valve 154 to its inactive position. A cam and follower arrangement is schematically illustrated in FIG. 1 which comprises a follower 206 attached to valve 154 and a cam 208 attached to the lift forks 13 on a lift truck for example. As will be apparent as the lift forks 13 are lowered they will reach a position in which cam 208 acts on follower 206 to move valve 154 to position 202 to interrupt conduit 170 and over-ride operation of the tilt limit valve. The function of the over-ride valve 154 is to permit tilting of the load when the load is below a predetermined maximum height since although the pressure of the load as reflected in chambers 96 would indicate that an unsafe load moment condition is present the operator will still be able to tilt the load to place the load for example, on the floor, since the load is at a very low position as indicated by the cam 208 and it would not be unsafe at this time to be able to operate the tilt controls. As will be apparent, the over-ride valve 154 can over-ride only the tilt limit valve function when the load moment is exceeding safe limits the lift limit valve 150 still being operative at such time to prevent lifting the load to any additional height. However, it will be apparent that the over-ride valve 154 could be connected to also over-ride the lift limit valve 150 to permit lifting the load under certain conditions, if deemed desirable.

The system of FIG. 1, is of the "open-center" type having a fixed displacement pump and a bypass valve to control the pump. Referring to FIG. 2, there is schematically illustrated a variable displacement pump 18*a* which can be used with the present control circuit for what is termed a "closed-center" system. In such a system the line 102*a*, which is the control signal conduit carrying a load responsive signal, will operate to change the displacement of pump 18*a* to vary the pump supply pressure in conduit 104*a* in accordance with the control signal in conduit 102*a*. In a manner similar to the embodiment of FIG. 1, when the load limiting system interrupts or connects the control signal conduit 102*a* to the sump or to conduit 110*a*, the pump displacement will correspondingly be reduced to reduce the output being supplied to conduit 104*a* and thus prevent further actuation of the tilt forward function or the lift function as described above with respect to FIG. 1.

Referring again to the system of FIG. 1, the flow control valve 26 as mentioned above, which is particularly described in U.S. Pat. No. 3,592,216 of common assignee, operates as a pressure reducing valve so that in the system disclosed herein the operation of manual valve 24 comprising the tilt circuit for a lift truck for example, can be adjusted to operate at a pressure level supplied to inlet port 60 lower than the system pressure being delivered to inlet port 60 of control valve 22 for the lift circuit. As discussed, tilting in a rearward direction or counterclockwise as viewed in FIG. 1, is to be permitted even for an over-capacity load, but it is important not to allow further elevation or lifting of the load while tilting in the backward direction. Due to the pressure reducing function of the flow control valve 26, the tilt circuit is operating at a lower pressure level than the lift circuit further lifting of the load will be impossible so that the load can be tilted in a rearward direction but the lift cylinder not be actuated since the lift cylinder is operating at a higher pressure capability.

With the addition of the flow control valve 26 acting as a pressure reducer, the lift limit valve 150 can be spring biased to a higher limiting level than the tilt limit valve 152. Therefore, as the critical load moment is reached, and the tilt limit valve 152 vents the control signal pressure in conduit 170, as is clearly described in U.S. Pat. No. 3,592,216, the flow control valve 26 will move to a position blocking the passage of fluid between supply conduit 104 and inlet 60 of manual valve 24 thus preventing further tilt cylinder movement. Under these conditions then only the lift circuit can be operated and the manual valve 22 be functional to lift the load at the particular pressure levels between the setting of lift limit valve 150 and tilt limit valve 152.

Figure 3:
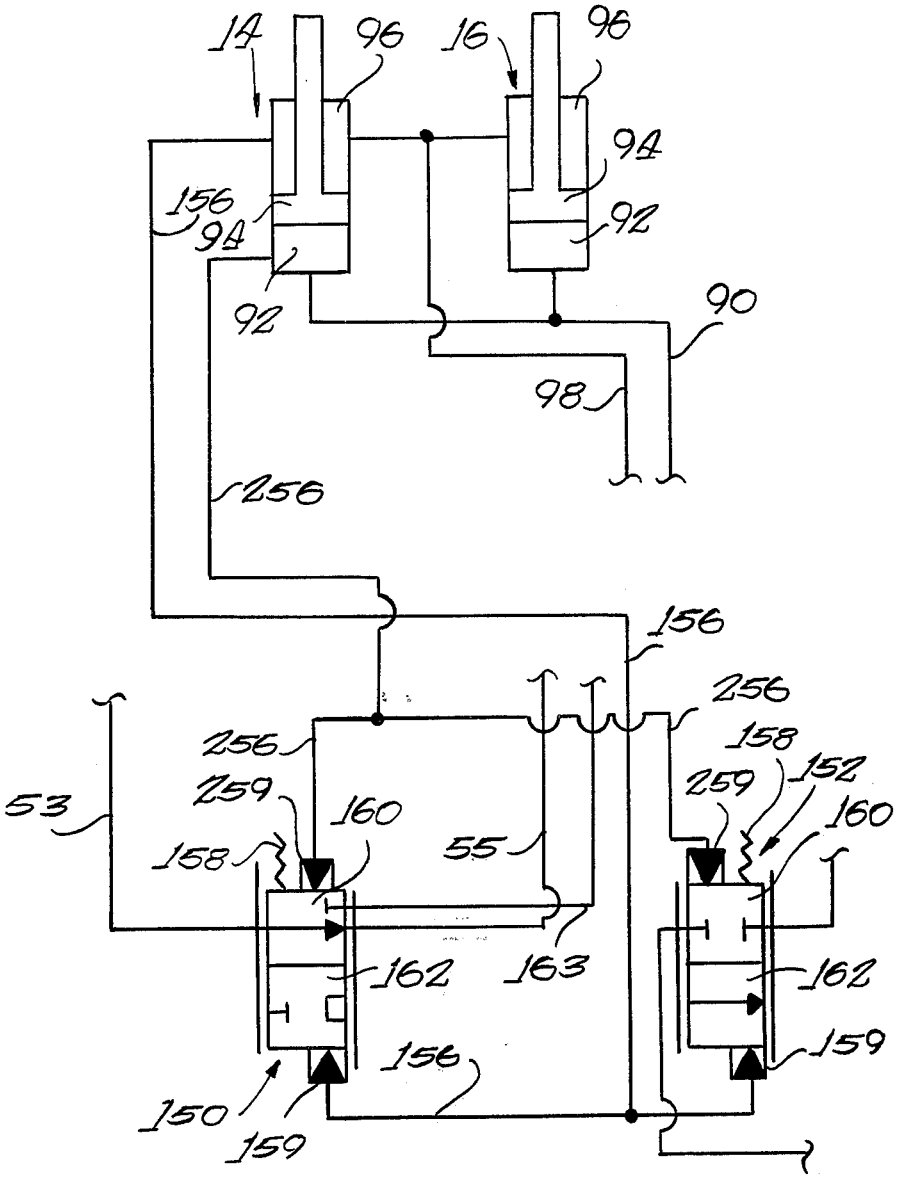
FIG. 3 is a schematic view of a modified form of the invention of FIGS. 1A and 1B.

In FIG. 3 is shown a modified form of the invention disclosing a system in which the limit valves 150 and 152 are responsive to the differential pressure between chambers 92 and 96 of the hydraulic cylinders 14 and 16. Valves 150 and 152 each have an actuator 259 therewith on the same end of the valve as spring 158. Actuator 259, which for example, would comprise a fluid responsive area on a valve spool, is connected by a fluid conduit 256 with chambers 92 of cylinders 14 and 16. As will be apparent, the valves 150 and 152 will be moved between positions 160 and 162 by the differential pressure between chambers 92 and 96. During conditions of unsafe load moment, the differential pressure between chambers 96 and 92 will be high, chamber 96 having the higher pressure, and valves 150 and 152 will be urged to the 162 position to prevent further tilt forward or lift movement.

From the above it will be apparent that the present invention provides a unique and improved hydraulic control circuit particularly adapted to control the lift and tilt cylinders for a lift or industrial truck. This system is a load responsive system having a unique load limiting feature preventing the lifting or forward tilting during conditions of unsafe load moments. The system as described above, also prevent similtaneous lifting or forward tilting during the over-capacity condition. The system advantageously also allows lowering of an over-capacity load at all times since the location of the lift limit valve 150 and tilt limit valve 152 in the logic circuits enables these valves to be effective only on the lift function and the tilt forward function. While providing the above advantages and safety features, at the same time, the unique system permits complete system performance as normal, when safe load moment conditions are encountered.

The various features of the invention have been particularly shown and described, however, it should be obvious to one skilled in the art that modifications may be made therein without departing from the scope of the invention.

What is claimed is:

1. In a hydraulic control system including a source of fluid supply; a fluid motor; a control valve connected to said motor; said control valve having an inlet port and a movable valving member which communicates pressure flow to said motor; a fluid responsive valve means connected to said source of fluid supply and said inlet port; a control circuit connected to said control valve and said fluid responsive valve means; said fluid responsive valve means being responsive to said control circuit to control the fluid supplied to said control valve; limit valve means connected to said motor and said control circuit; said limit valve means being responsive to predetermined pressure conditions at said motor to reduce the pressure in said control circuit to thereby reduce the fluid supply and prevent further actuation of said motor.

2. A control system as claimed in claim 1 wherein said limit valve has at least one fluid responsive area connected to said motor to move said valve to reduce the pressure in said control circuit and a spring resisting such movement.

3. A control system as claimed in claim 2 wherein said limit valve has an inactive position and a limit position to which it is moved by pressure acting on said fluid responsive area, and said limit valve in said limit position providing a connection between said control circuit and said return conduit.

4. In a hydraulic system including a source of fluid supply comprising a pump, a fluid motor; a control valve connected to said source and said motor and having an inlet port, first and second motor ports, first and second control ports, and a movable valving member to direct pressure flow to said motor, to receive flow back from said motor; and to connect one of said control ports to one of said motor ports when said one motor port is connected to said inlet port; conduit means connecting said pump to said inlet port, and said motor ports to said motor; a fluid responsive means connected to said conduit means interconnecting said source of fluid supply and said inlet port and responsive to a control signal pressure to control the fluid supplied to said control valve; shuttle valve means connected to said first and said second control ports; a control conduit connecting said shuttle valve and said fluid responsive means; said shuttle valve means being effective to allow fluid from the control port that is connected to the motor port by said movable valving member to flow to said fluid responsive means for use as said control signal pressure; limit valve means connected to said control conduit and said fluid motor; said limit valve means being responsive to predetermined fluid pressure conditions at said motor to reduce the signal pressure in said control conduit and prevent further actuation of said motor; said limit valve means has a fluid responsive area connected to said fluid motor; said limit valve means having an inactive position and a limit position to which it is moved by pressure acting on said fluid responsive area; and said limit valve means in said limit position providing a connection between said control circuit and said return conduit.

5. A control system as claimed in claim 4 wherein said fluid motor has two chambers and said limit valve has a fluid responsive area connected to each of said chambers to move said valve to reduce the pressure in said control circuit and a spring resisting such movement.

6. In a hydraulic control system including a source of fluid supply; a first fluid motor having a piston connected to a load for moving the load through one path of movement; a second fluid motor connected to the load to move same through a different path of movement; the first motor having a pair of fluid chambers; the load acting to create a pressure in one of said chambers which will vary directly with the load; a control valve connected to each of said motors and each having an inlet port and a movable valving member adapted to direct pressure flow to the motors to actuate same; a fluid responsive valve connected to said source of fluid supply and said inlet ports; a control circuit connected to said control valves and said fluid responsive valve; said fluid responsive valve being responsive to said control circuit to control the fluid supplied to said control valves; a first limit valve associated with said first motor and connected to said one chamber and said control circuit; a second limit valve associated with said second fluid motor and connected to said one chamber and said control circuit; each of said limit valves being responsive to a predetermined pressure in said one chamber to reduce the pressure in said control circuit to thereby reduce the fluid supply and prevent further actuation of its respective motor.

7. A control system as claimed in claim 6 wherein each of said limit valves has a fluid responsive area to move said limit valves to reduce the pressure in said control circuit and biasing means imposing a force on said valve resisting such movement.

8. A control system as claimed in claim 7 wherein said biasing means imposes a different force on one of said limit valves as compared to the other whereby one of said limit valves will reduce the pressure in said control circuit at a different pressure in said one chamber as compared to the pressure at which said other limit valve will interrupt said control circuit.

9. A control system as claimed in claim 6 wherein an over-ride valve means is connected between said control circuit and one of said limit valves, cam means connected to said load and movable therewith during lifting and lowering movement of said load, whereby at predetermined heights of said load said over-ride valve will be actuated by said cam means to prevent said limit valve means from interrupting said control circuit.

10. In a hydraulic control system including a source of fluid supply; a fluid motor having a piston connected to a load; the motor having a pair of fluid chambers; the load acting to create a pressure in one of said chambers which will vary directly with the load; a control valve connected to said fluid motor having an inlet port and a movable valving member to direct pressure flow to said motor; a fluid responsive means connected to said source of fluid supply and said inlet port; a control circuit connected to said control valve and said fluid responsive means; said fluid responsive means being responsive to said control circuit to control the fluid supplied to said control valve; limit valve means connected to said chambers and said control circuit; said limit valve means being responsive to the pressure differential of said chambers to reduce the pressure in said control circuit to thereby reduce the fluid supply and prevent further actuation of said motor.

11. In a hydraulic control system including a source of fluid supply; a first fluid motor having a piston connected to a load and adapted to move the load through one path of movement; a second fluid motor connected to the load adapted to move same through a different path of movement; the first motor having a pair of fluid chambers; the load acting to create a pressure in one of said chambers which will vary directly with the load; a control valve connected to each of said motors and each having an inlet port and a movable valving member to direct pressure flow to the motors to actuate same; a fluid responsive valve connected to said source of fluid supply and said inlet ports; a control circuit connected to said control valves and said fluid responsive valve; said fluid responsive valve being responsive to said control circuit to control the fluid supplied to said control valves; a first limit valve associated with said first motor and connected to said chambers and said control circuit; a second limit valve associated with said second fluid motor and connected to said chambers and said control circuit; each of said limit valves being responsive to a predetermined pressure differential between said chambers to interrupt said control circuit to thereby reduce the fluid supply and prevent further actuation of its respective motor.

12. In a hydraulic control system adapted for use with a load-lifting vehicle having at least one hydraulic tilt cylinder for tilting a load; a source of fluid supply; a return conduit to return fluid to said source; said tilt cylinder having a piston connected to a load; the tilt cylinder having a first hydraulic chamber for forward tilting and a second hydraulic chamber for rearward tilting; the load acting to create a pressure in said second chamber which will vary directly with the size of the load; a control valve connected to said cylinder having an inlet port and a movable valving member to direct pressure flow to said motor; a fluid responsive means connected to said source of fluid supply and said inlet port; a control circuit connected to said control valve and said fluid responsive means; said fluid responsive means being responsive to said control circuit to control the fluid supplied to said control valve; limit valve means connected to said first and second hydraulic chambers and said control circuit; said limit valve means being responsive to a predetermined pressure differential between said first and second chambers to reduce the pressure in said control circuit to thereby reduce the fluid supply and prevent further actuation of said motor.

13. A hydraulic control system as claimed in claim 12 including a hydraulic lift cylinder adapted to move said load to selective heights; said lift cylinder having a pressure chamber and a piston connected to said load; a second limit valve means connected to said first and second hydraulic chambers and said control circuit; said second limit valve means being responsive to a predetermined pressure differential between said first and second hydraulic chambers to interrupt said control circuit to thereby reduce the fluid supply and prevent further lifting of said load by said second hydraulic cylinder.

* * * * *